US005551644A

United States Patent [19]

Linderoth

[11] Patent Number: 5,551,644

[45] Date of Patent: Sep. 3, 1996

[54] METHOD OF AND A DEVICE FOR WINDING A WIRE-LIKE PRODUCT ON A FLANGED REEL

[75] Inventor: Gustaf Linderoth, Enköping, Sweden

[73] Assignee: Nokia-Maillefer Oy, Finland

[21] Appl. No.: 284,651

[22] PCT Filed: Feb. 10, 1993

[86] PCT No.: PCT/FI93/00034

§ 371 Date: Aug. 23, 1994

§ 102(e) Date: Aug. 23, 1994

[87] PCT Pub. No.: WO93/15991

PCT Pub. Date: Aug. 19, 1993

[30] Foreign Application Priority Data

Feb. 12, 1992 [SE] Sweden ..... 9200412

[51] Int. Cl.[6] ..... B65H 57/28; B65H 54/00

[52] U.S. Cl. ..... 242/158.4 R; 242/25 R; 242/36

[58] Field of Search ..... 242/158.4 R, 25 R, 242/36, 158 R

[56] References Cited

U.S. PATENT DOCUMENTS

| | | | |
|---|---|---|---|
| 3,951,355 | 4/1976 | Morioka et al. | 242/158.4 R X |
| 3,997,128 | 12/1976 | Hara et al. . | |
| 4,143,834 | 3/1979 | Hara et al. . | |
| 4,150,801 | 4/1979 | Ikegami et al. . | |
| 4,244,539 | 1/1981 | Taneda et al. | 242/158 R |
| 4,410,147 | 10/1983 | Seibert | 242/158.4 R X |
| 4,411,396 | 10/1983 | Kytir | 242/158.4 R X |
| 4,616,791 | 10/1986 | Harvey | 242/158 R X |
| 5,209,414 | 5/1993 | Clemens et al. | 242/158 R X |
| 5,364,043 | 11/1994 | Linderoth | 242/158 R X |

FOREIGN PATENT DOCUMENTS

| | | | |
|---|---|---|---|
| 1902722 | 9/1970 | Germany . | |
| 1574425 | 10/1970 | Germany . | |
| 3-62417 | 3/1991 | Japan | 242/158 R |
| 4-16463 | 1/1992 | Japan | 242/158 R |
| 4-292377 | 10/1992 | Japan | 242/158 R |
| 5-310369 | 11/1993 | Japan | 242/158 R |
| 466702 | 3/1992 | Sweden . | |
| 466602 | 3/1992 | Sweden . | |
| 2151268 | 7/1985 | United Kingdom | 242/158.4 R |
| WO91/19664 | 12/1991 | WIPO | 242/158 R |

*Primary Examiner*—Michael R. Mansen
*Attorney, Agent, or Firm*—Nixon & Vanderhye P.C.

[57] ABSTRACT

A method of winding a cable on a rotating reel by way of a guide at an angle of lag which is changed at both reel flanges through a position parallel with the flange to an opposite angle of lag when a cable turn comes into contact with the reel flange. To wind the cable turns more closely together at the reel flanges, the angle of lag is changed into the position parallel with the reel flange before the cable turn comes into contact with the reel flange. A device for applying the method in a cable winding machine comprises detecting devices supposed by the guide for detecting each reel flange and for changing the angle of lag of the cable to its parallel position before reversing devices detect the reel flange and reverse the direction of displacement of the guide with respect to the reel.

9 Claims, 4 Drawing Sheets

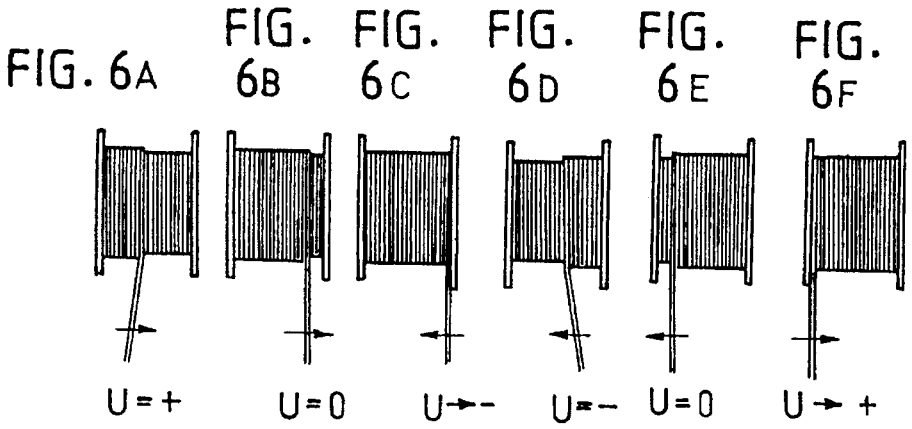
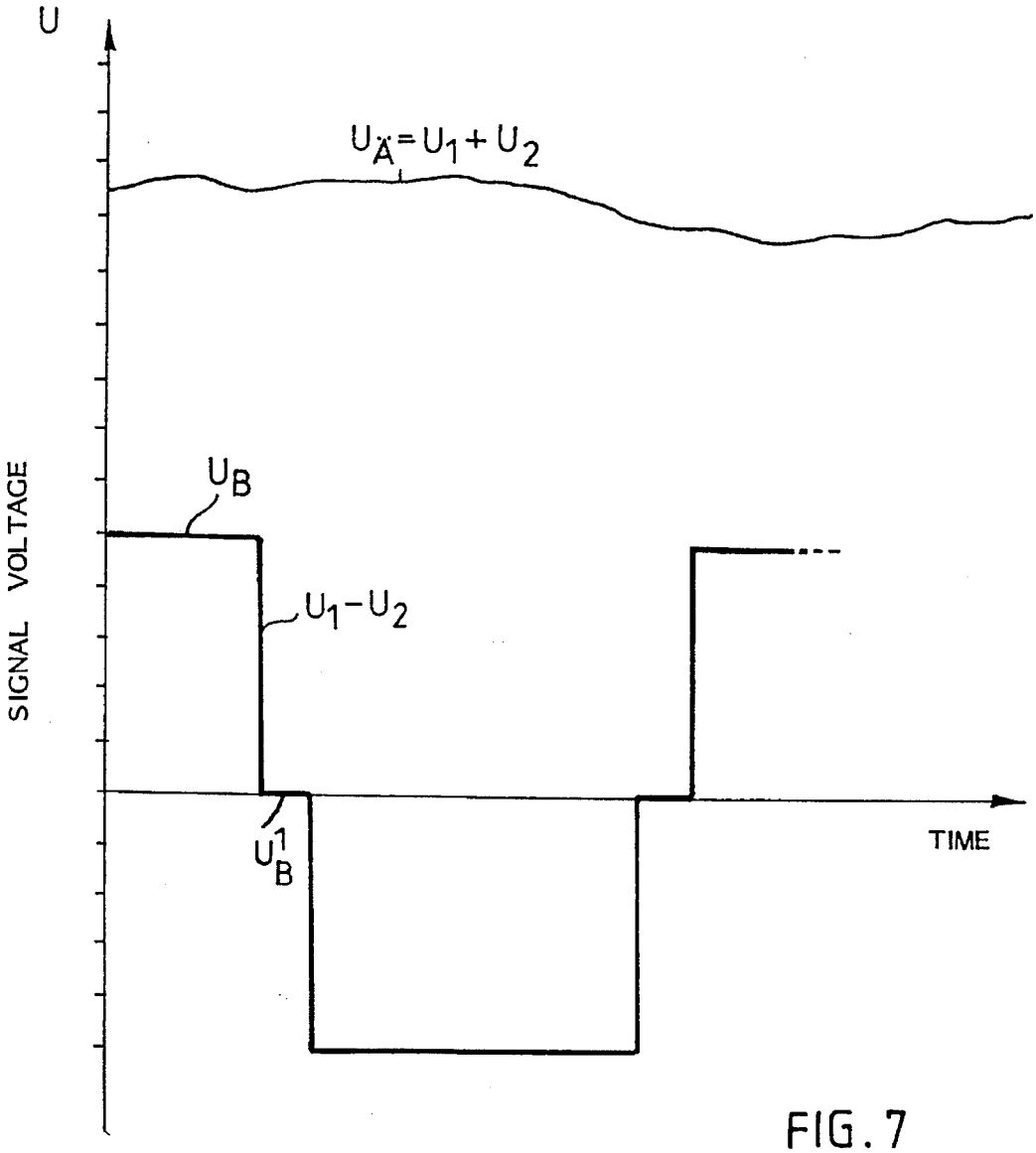
FIG. 7

METHOD OF AND A DEVICE FOR WINDING A WIRE-LIKE PRODUCT ON A FLANGED REEL

The present invention relates to a method of winding a wire-like product, such as a cable, on a flanged reel in a winding machine, wherein the reel is supported rotatably about its axis by means of a support structure;

the cable is passed on the reel to form superimposed layers of adjacent cable turns wound between reel flanges by means of a guide;

the support structure and the guide are displaced with respect to each other with a pitch corresponding to the cable thickness per one cable turn, the cable being wound on the reel at an angle of lag with respect to adjacent cable turns, which angle is changed at each reel flange through a position parallel with the flange into an opposite angle of lag when a cable turn comes into contact with the reel flange.

As used in this connection, the expression "wire-like product" refers to all kinds of long narrow continuous objects which can be wound on a reel, such as cables, conductors, and hoses, mainly products used in the manufacture of electric cables and data transmission conductors. For the sake of clarity, however, the invention will be described below with reference to a cable.

When a cable is wound on a reel or drum, a guide is used so that the cable will be positioned between the flanges of the reel in superimposed layers each comprising a number of adjacent cable turns.

In most prior art winding machines, e.g. U.S. Pat. No. 4,143,834 (FURUKAWA), U.S. Pat. No. 4,150,801 (KOBE STEEL), and U.S. Pat. No. 3,997,128 (FURUKAWA), the winding movements are effected by axially displacing the cable guide and the reel with respect to each other in the axial direction of the reel in such a way that when the reel accomplishes one revolution, the guide or the reel is displaced a distance equal to the thickness of the cable. The prior art winding machines are normally adjustable for handling reels having different drum diameters and different distances between the reel ends. The machines are also provided with a distributing machinery, by means of which the axial displacement between the guide and the reel for each revolution of the reel, i.e. the pitch at which the cable is wound on the reel, can be adjusted so that it always corresponds to the thickness of the cable to be wound.

It is well-known in the cable manufacture that the best and densest winding result on the reel is obtained when the cable to be wound forms an oblique angle of lag with respect to the axis of the reel during the winding.

It is also well-known that it is advantageous that the product to be wound is directed in parallel with the reel flange when a reeled cable turn comes into contact with the flange, i.e. that the angle of lag is reduced to zero. Swedish Patent Application 9000662 (NOKIA-MAILLEFER) discloses a winding machine in which the angle of lag is reduced to zero, that is, the cable is wound at right angles to the axis of the reel and in parallel with the reel flange by means of a simple rotatable pair of rollers. German Auslegeschrift 1 902 722 (ROSENDAHL) discloses a winding machine in which the reduction of the angle of lag to zero at the reel flange and its restoration to its proper value after the reversion of the direction of the displacing movement of the guide is performed by accelerating/retarding the displacing movement of the guide with respect to the reel.

A drawback of the above-mentioned winding methods and machines is that it is still difficult to wind the cable sufficiently densely at the critical reel flanges, where the direction of the guide is reversed and the cable starts a new layer upon the previous ones.

The object of the present invention is to provide a winding method which avoids the above-mentioned drawback and enables the cable to be wound densely and without disturbances even close to the reel flanges. This is achieved by means of a method which is characterized in that the angle of lag is changed into the position parallel with the flange before the cable turn comes into contact with the reel flange.

The method according to the invention is based on the idea that the angle of lag of the cable is reduced to zero, that is, the winding of the cable on the reel at right angles to the reel axis is started preferably several cable turns before the cable comes into contact with the reel flange and the guide reaches its turning point. In this way the cable has time enough to assume a position parallel with the flange before the flange forces it into the parallel position.

The invention also relates to a device in a winding machine, and this device is characterized in that the winding machine comprises detecting means for each reel flange for detecting the reel flange and changing the angle of lag into said parallel position before the reversing means detect the reel flange and reverse the direction of displacement of the guide with respect to the reel.

Swedish Patent Application 9002141 (NOKIA-MAILLEFER) relates to a winding machine provided with sensing means for continuously sensing the cable thickness and for controlling the reversion of the displacement of the guide in the axial direction of the reel in response to the sensing movements of the sensing means. In this way the location of the turning points of the guide at the reel flanges can be adapted to possible variations in the cable thickness.

In a preferred embodiment of the device according to the invention, the detecting means for resetting the angle of lag are arranged to be displaced in the axial direction of the reel in synchronization with the movements of the sensing means due to variations in the cable thickness.

When using the device according to the invention, the turning points of the guide need not be calculated and no manual adjustments are needed with different reel dimensions and reel widths, but the device automatically determines the appropriate turning points and the appropriate angle resetting points with mechanical means both when winding cables with different diameters and cables with a varying diameter.

In the following the invention will be described more closely with reference to the attached drawings, in which FIGS. 1A to 1C illustrate schematically the basic idea of the present invention;

FIG. 6A–6F illustrates the variation of the signal voltage according to the angle of lag in six different angle positions; and FIG. 7 illustrates diagrammatically the signal voltage of the distributing machinery as a function of the displacing time of the guide.

Figure 1A:
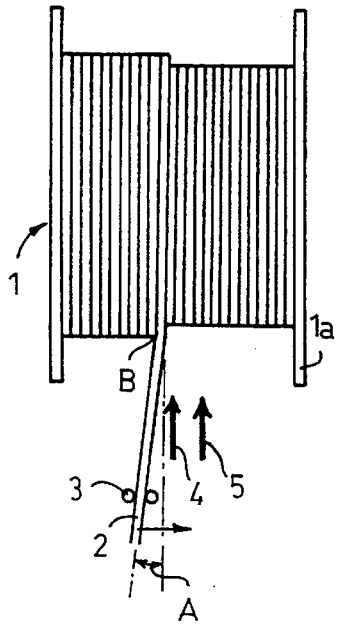
Figure 1B:
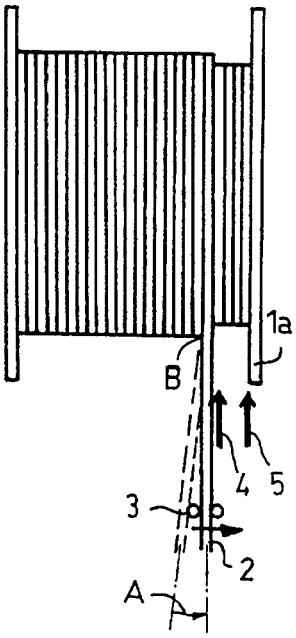
Figure 1C:
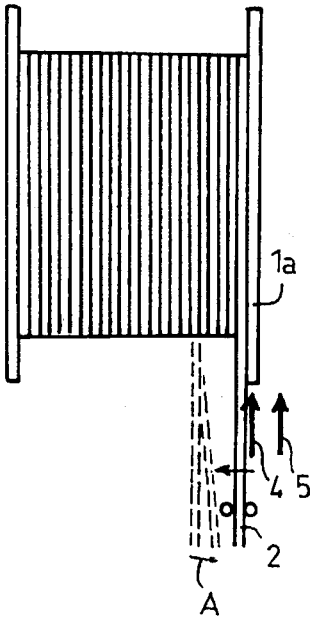

FIGS. 1A to 1C, which illustrate the idea of the invention, show a reel 1 on which a cable 2 is wound between reel flanges la by means of a guide 3. The reel and the guide are displaced with respect to each other in the axial direction of the reel so that the cable will be wound turn by turn on the previously wound cable layers. When the cable reaches a reel flange, the direction of movement of the guide is reversed.

The guide is provided with two detectors 4 and 5, of which the detector 4 closer to the cable detects the presence of the reel flange in line with the outer side of the cable while the other detector 5 detects the presence of the reel flange already before the first detector 4. The purpose of the detector 4 is to give a signal for reversing the direction of the relative displacing movement of the guide and reel. The purpose of the detector 5 is to give a signal for setting the angle of lag of the cable to zero.

In FIG. 1A, the cable is wound on the reel at a certain angle of lag A so that the guide has a corresponding lag with respect to a point B on the reel at which the cable runs beside a previously wound cable turn.

In FIG. 1B, the second detector 5 has detected the reel flange and caused the displacing movement of the reel to be accelerated so that the lag of the guide is eliminated and the guide reaches such a position with respect to the entering point B of the cable on the reel that the angle of lag of the cable is zero. In this position the cable is wound at right angles to the reel axis and in parallel with the reel flange.

In FIG. 1C, the cable has been further wound on the reel without any angle of lag until the first detector 4 detects the reel flange when the cable comes into contact with the reel flange and causes the direction of the displacing movement of the reel to be reversed. After a few cable turns have been wound on the reel without any angle of lag, i.e. in parallel with the reel flange, the displacing movement of the guide is retarded so that the guide again begins to lag, and the cable is wound on the reel at a desired angle of lag A. This is shown by broken lines in FIG. 1C.

The guide has, of course, a similar pair of detectors for the other reel flange.

Figure 2:
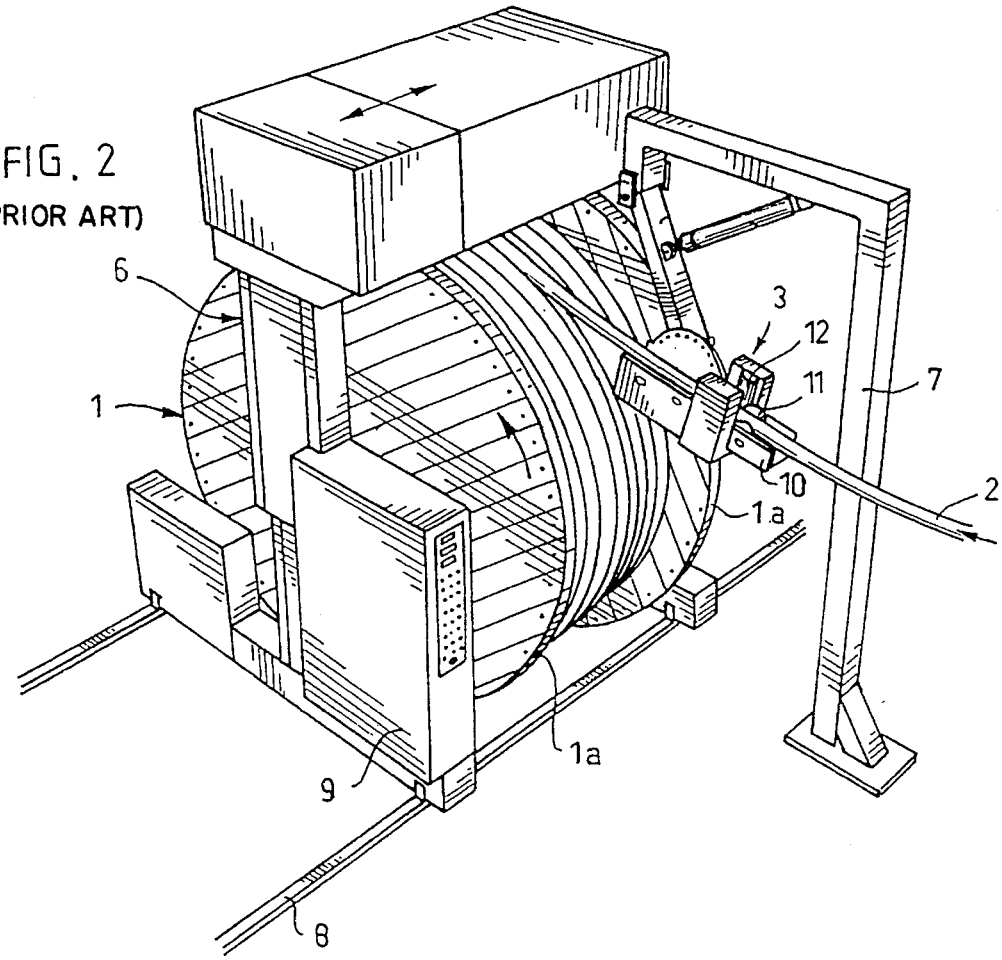
FIG. 2 (PRIOR ART)
FIG. 2 is a perspective view of to a prior art cable winding machine according to Swedish Patent Application 9002141.

The winding machine shown in FIG. 2 mainly comprises a support structure 6 for a reel 1 and a guide 3 for a cable 2 to be wound on the reel. The guide is supported by a stationary bracing 7, whereas the support structure is wheeled and displaceable along rails 8 by means of a distributing machinery shown only schematically with the reference numeral 9. The reel is axially displaceable by means of the distributing machinery to and fro in front of the guide so that the cable will be wound on the reel turn by turn in superimposed layers between the ends 1*a* of the reel. This type of winding machine is previously known and therefore will not be described more closely below (e.g. SE Patent Application 9000662).

Figure 3:
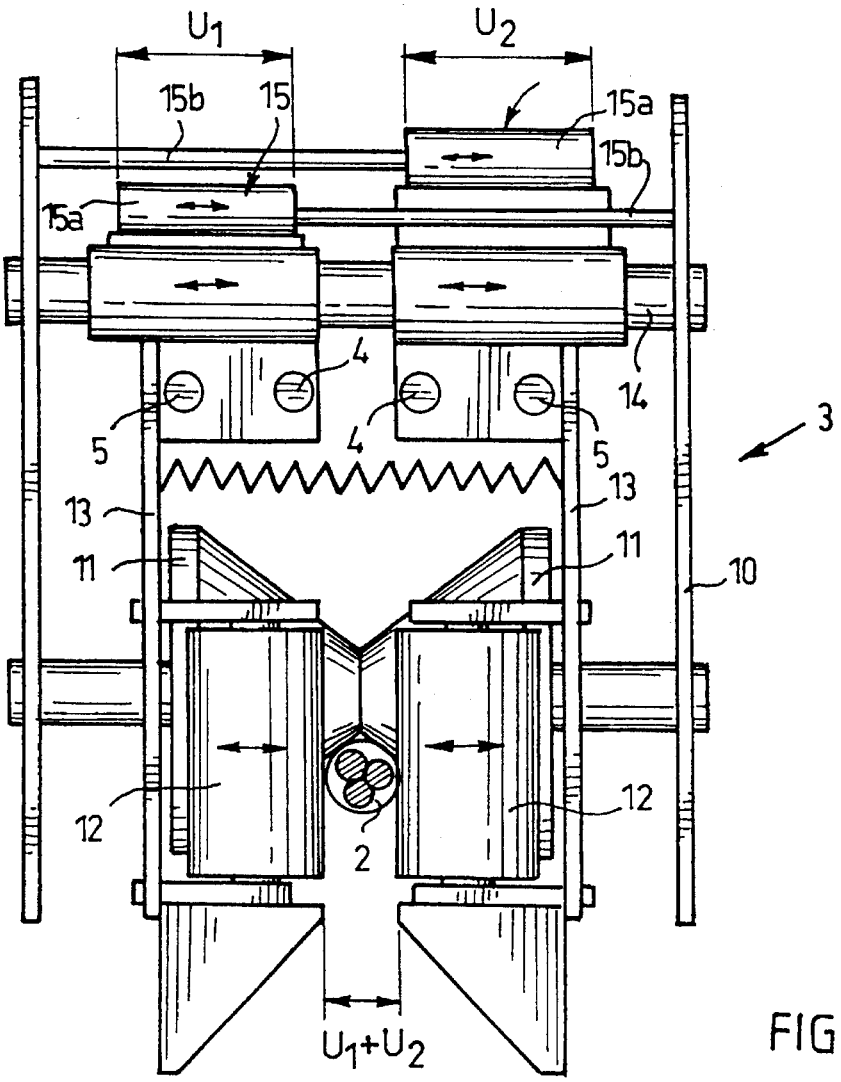
FIG. 3 is an enlarged vertical view of the cable guide of the winding machine; in accordance with this invention
Figure 4:
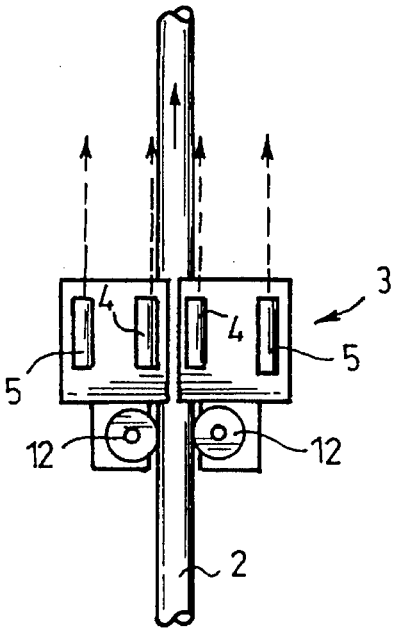
FIG. 4 is a considerably simplified top view of the guide.

The guide 3 shown in FIGS. 3 and 4 comprises a frame 10 in which a V-shaped guide roll 11 is mounted rotatably on a shaft transverse to the longitudinal direction of the cable. The guide further comprises two measuring rolls 12 which are fastened on the opposite sides of the cable by means of supports 13 arranged slideably on shafts 14 parallel with the shaft of the guide roll. Both supports support a signal generator 15 formed by an electric slide rheostat having one element 15*b* attached to the frame and another element 15*a* attached to the support.

Both supports further support two detectors 4 and 5 which correspond to the detectors shown in FIGS. 1A to 1C, that is, the detector 4 for reversing the direction of the displacing movement of the guide, and the detector 5 for setting the angle of lag of the cable to zero.

Figure 5:
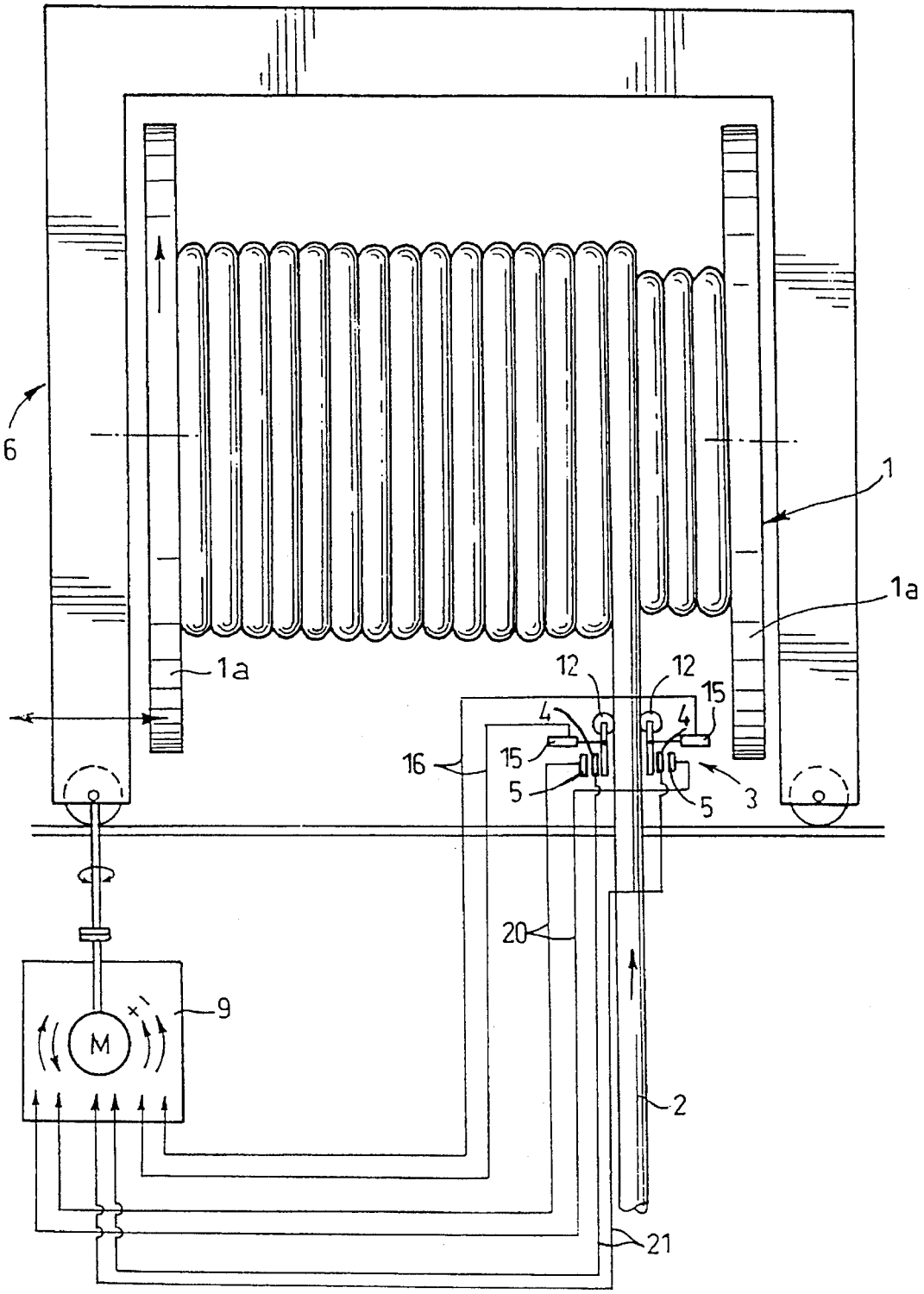
FIG. 5 illustrates the cooperation between the guide, the distributing machinery, the support structure and the reel.

The signal generators 15 are connected to the distributing machinery 19 by means of cables 16, FIG. 5. The signal generators respond continuously to variations in the thickness of the cable via the measuring rolls and sends electric signals through the cables 16 to the distributing machinery in order to cause a corresponding increase or decrease in the axial displacement of the reel per one cable turn by means of calculators and processors.

The detectors 5, e.g. photocells, are connected by means of cables 20 to the distributing machinery 9. When the detector detects the reel flange 1*a*, it sends a signal through the cable to the distributing machinery to increase the axial displacement of the reel per one cable turn (when the winding of the cable takes place towards the reel flange) or to decrease the displacement of the reel (when the winding of the cable takes place in a direction away from the reel flange) in an amount such that the angle of lag of the cable is set to zero or reaches a desired value, respectively. The angle of lag can be determined by means of the signal generators 15 in the following way:

The signal generators 15 generate a signal voltage $U_1$ and $U_2$, respectively, FIG. 5. When the angle of lag is zero, the voltages are equal, and the difference $U=U_1-U_2=O$, as shown in FIG. 6, in the situations B and E. The difference $U_1-U_2$ is proportional to the angle of lag of the cable. When the difference $U=U_1-U_2$ is positive, the angle of lag of the cable is opposite to the angle at which the difference $U=U_1-U_2$ is negative, as shown in FIG. 6, in the situations A and D.

The distributing machinery 9 gives a set value $U_B$ for the signal voltage $U_1-U_2$ during the winding of the cable, as shown in FIG. 7, which set value corresponds to the desired angle of lag of the cable. The distributing machinery also gives a set value $U_B^1$ for the signal voltage $U_1-U_2$ when the cable is wound at right angles to the axis of the reel.

Alternatively, the sensing of the cable thickness may be carried out by means of the measuring rolls 12, which are connected to the signal generators 15. The sum of the signal voltages $U_1$ and $U_2$, that is, the actual value $U_K$ for the signal voltages $U_1+U_2$, is proportional to the cable thickness.

The detectors 4, such as photocells, are connected by means of cables 21 to the distributing machinery 9. When the detector detects the reel flange, it sends an electric signal to the distributing machinery to cause it to reverse the direction of the displacing movement of the reel.

The drawings and the description related to them are only intended to illustrate the idea of the invention. In its details, the invention may vary within the scope of the claims. The method and the device according to the invention may also be applied in winding machines having no means for sensing variations in the cable thickness, and in machines where the direction of the displacing movement of the guide or the reel is reversed by devices different from those described herein. In place of using a displaceable reel and a stationary guide, as in FIGS. 2 to 5, the reel may be stationary and the guide displaceable. The guide means for setting the angle of lag of the cable to zero and resetting it to a predetermined angle may also be mechanical means supported by the guide, e.g. of the type shown in Swedish Patent Application 9000662. The signal generators 15 may also be analogous ultrasonic measuring means or analogous optical IR measuring means.

I claim:

1. In a method of winding a cable on a flanged reel of a winding machine including providing a reel having at least one flange and rotatably supported on a support structure; winding the cable onto the reel to form superimposed layers of adjacent cable turns between said at least one flange on the reel by a guide structure; displacing the support structure and the guide structure relative to each other with a pitch corresponding to a thickness of the cable per one cable turn; winding the cable on the reel at a first lag angle with respect to a point on the reel at which the cable runs beside a previously wound and adjacent cable turn on the reel; and changing the first lag angle to a zero lag angle and then to a second lag angle opposite said first lag angle when another cable turn contacts the reel flange; the improvement comprising:

changing the lag angle to zero before said another cable turn contacts the reel flange.

2. Method according to claim 1 wherein said first lag angle is changed to said zero lag angle at least one cable turn before said another cable turn comes into contact with the reel flange.

3. Method according to claim 2 wherein said first lag angle is changed to said zero lag angle several cable turns before said another cable turn comes into contact with the reel flange.

4. Method according to claim 1 wherein said first angle of lag is changed to said zero lag angle by accelerating displacement of the reel with respect to the guide.

5. A winding machine for winding a cable on a flanged reel comprising:

a reel mounted on a support structure for rotation about an axis of the reel, said reel having flanges at opposite ends thereof;

a cable guide for passing the cable onto the reel to form superimposed layers of adjacent cable turns wound between said flanges;

displacement means for displacing the support structure and reel relative to said cable guide in a first direction of movement at a pitch corresponding to a thickness of the cable per one cable turn, and at a first lag angle with respect to a point on the reel at which the cable runs beside a previously wound and adjacent cable turn on the reel;

first detector means for sensing one of said flanges and for reversing said first direction of movement of said support structure and reel when another cable turn contacts said one flange; and second detector means for sensing said one of said flanges and for changing said lag angle to zero before said first detector means reverses said first direction of movement.

6. The winding machine according to claim 5 wherein said second detector means are connected to said displacement means for accelerating the displacement of the reel with respect to the guide and for changing said first lag angle to said zero lag angle at least one cable turn before said another cable turn contacts said one flange.

7. The winding machine according to claim 6, wherein said second detector means are supported by the cable guide.

8. The winding machine according to claim 7, where the winding machine is provided with means for sensing the thickness of the cable as the cable passes through the cable guide, and for controlling said displacement means in response to said sensing means, and further wherein said second detector means are connected to be displaced in the axial direction of the reel in synchronization with the movements of the sensing means in response to variations in the thickness of the cable.

9. The winding machine according to claim 5, wherein said guide includes means for displacing the cable relative to the guide in an amount corresponding to the cable thickness in either direction from the cable axis at said flange, and further wherein said second detector means are connected to the means for displacing the cable from said first lag angle to said zero lag angle at a distance of at least one cable turn from the reel flange.

* * * * *